US005448973A

United States Patent [19]

Meyer

[11] Patent Number: 5,448,973

[45] Date of Patent: Sep. 12, 1995

[54] METHOD OF REDUCING THE PRESSURE AND ENERGY CONSUMPTION OF HYDRAULIC ACTUATORS WHEN ACTIVATING ENGINE EXHAUST VALVES

[75] Inventor: Lawrence L. Meyer, Northville, Mich.

[73] Assignee: Eaton Corporation, Cleveland, Ohio

[21] Appl. No.: 340,492

[22] Filed: Nov. 15, 1994

[51] Int. Cl.[6] ..... F01L 9/02

[52] U.S. Cl. ..... 123/90.12; 123/315

[58] Field of Search ..... 123/90.11, 90.12, 90.13, 123/90.15, 315

[56] References Cited

U.S. PATENT DOCUMENTS

| | | | |
|---|---|---|---|
| 3,682,152 | 8/1972 | Muller-Berner | 123/90.12 |
| 4,200,067 | 4/1980 | Trenne | 123/90.12 |
| 4,296,911 | 10/1981 | Escobosa | 123/90.12 |
| 4,974,495 | 12/1990 | Richeson, Jr. | 123/90.12 |
| 5,197,419 | 3/1993 | Dingess | 123/90.13 |
| 5,209,453 | 5/1993 | Aota et al. | 123/90.12 |
| 5,221,072 | 6/1993 | Erickson et al. | 123/90.12 |
| 5,231,959 | 8/1993 | Smietana | 123/90.12 |
| 5,255,641 | 10/1993 | Schechter | 123/90.12 |
| 5,275,136 | 1/1994 | Schechter et al. | 123/90.12 |

*Primary Examiner*—Henry C. Yuen
*Assistant Examiner*—Weilun Lo
*Attorney, Agent, or Firm*—Loren H. Uthoff, Jr.

[57] ABSTRACT

A method of operating at least two exhaust valves in an engine cylinder using a four-way hydraulic actuator to open a first exhaust valve and after a time delay using a three-way hydraulic actuator to open a second exhaust valve to minimize the overall energy consumption in operating engine valves using hydraulic actuators.

3 Claims, 2 Drawing Sheets

FIG 1
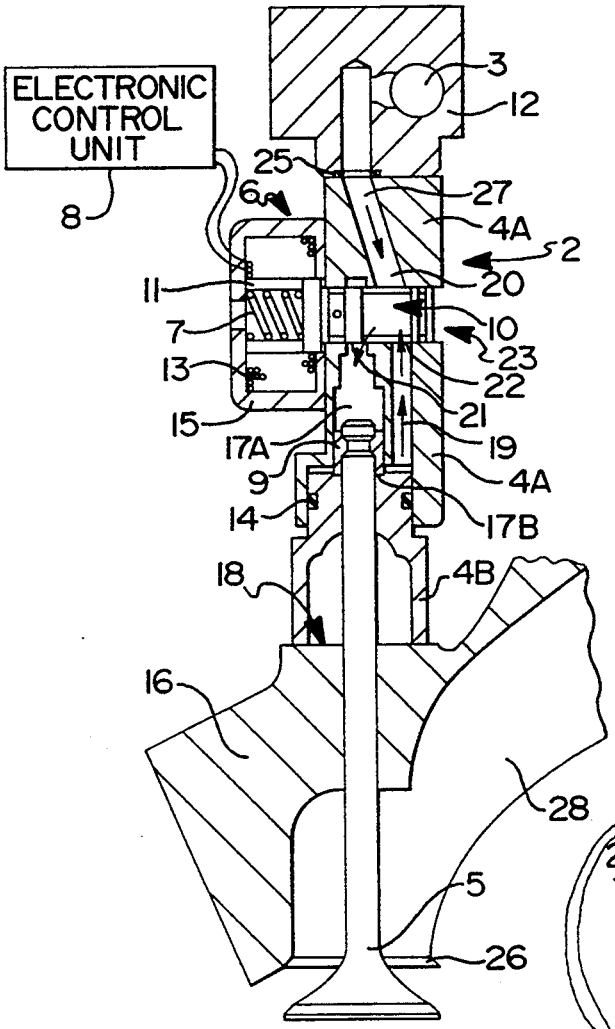
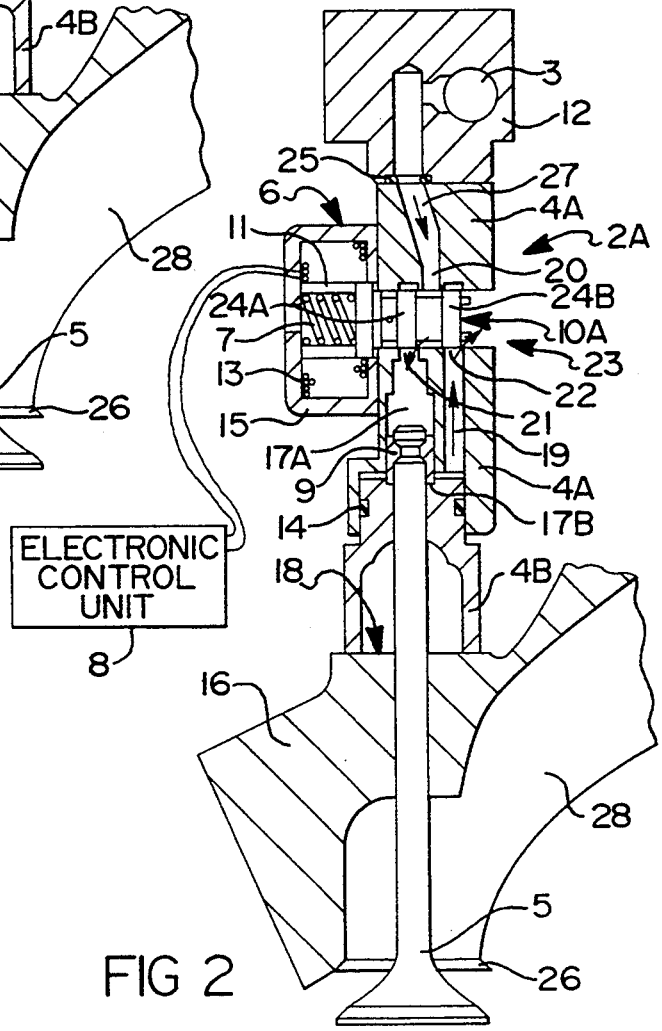
FIG 2

FIG 3
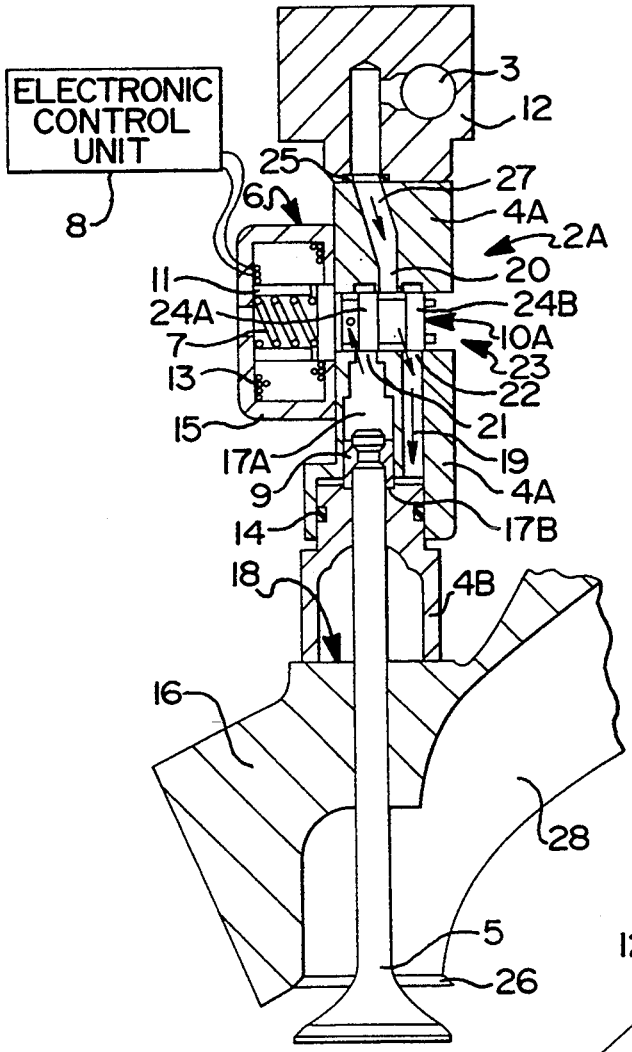
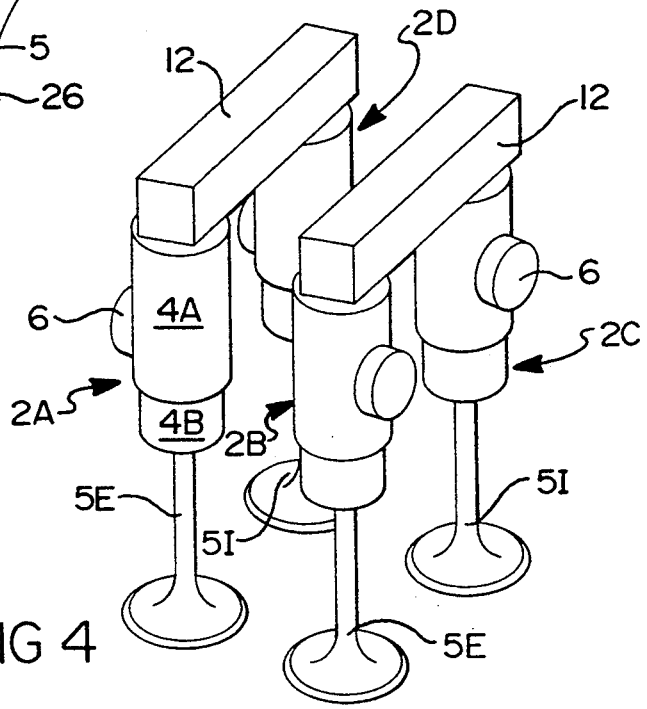
FIG 4

METHOD OF REDUCING THE PRESSURE AND ENERGY CONSUMPTION OF HYDRAULIC ACTUATORS WHEN ACTIVATING ENGINE EXHAUST VALVES

BACKGROUND OF THE INVENTION

1. Field of the Invention

The present invention relates to hydraulic actuators for engine valves. More specifically, the present invention relates to hydraulic actuators for engine valves where both a three-way and a four-way actuator is used to open and close at least two exhaust valves per engine cylinder.

2. Description of the Prior Art

It is known to use hydraulic power in some type of electronically controlled actuator to open an engine valve without using a camshaft as may be seen by reference to U.S. Pat. Nos. 4,200,067; 4,974,495; 5,197,419; 5,221,072; and 5,275,136; the disclosures of which are hereby expressly incorporated by reference. The hydraulic activation is supplied by high pressure oil from an axillary pressure source such as a pump, and in some cases, a low pressure source is also used. Electronically controlled solenoid or spool valves open and close hydraulic ports to control the flow of hydraulic oil in and out of one or two chambers on either side of a working piston which is connected to the engine valve.

During operation, the engine exhaust valve in each cylinder must open against a residual cylinder pressure remaining after the power stroke of a four-cycle engine. Approximately 150 pounds per square inch of pressure remains in the cylinder when the exhaust valve is required to open to allow the combustion products to be pushed out of the cylinder by the piston. After the exhaust valve opens, the residual pressure quickly subsides as the gas products flow out the open exhaust valve, and the piston commences the exhaust stroke to further clear the cylinder of combustion products.

Initially, the hydraulic actuator must have the capability to open the exhaust valve against this relatively high cylinder pressure acting against the cross-sectional area of the exhaust valve tending to hold it closed. The intake valve does not have to be opened against cylinder pressure so the force capability of the hydraulic actuator operating the intake valve can be at a lower level. Traditionally, a higher pressure for the first to open exhaust valve has been used to ensure a high probability of opening the exhaust valve at the desired time, and high energy consumption results because of the increased hydraulic losses at higher pressure.

SUMMARY OF THE INVENTION

The present invention allows for a lower overall energy consumption to operate the exhaust valves of an engine that uses two or more exhaust valves. A four-way hydraulic valve actuator is used to open the first exhaust valve in each cylinder while a three-way hydraulic valve actuator is used to open the other exhaust valves. Thus, according to the present invention, one four-way actuator is used for each cylinder to open the first exhaust valve with the remaining exhaust (and intake) valves operated by three-way actuators. The three-way actuator is defined for purposes of this disclosure as one in which oil passes external to a control valve only through one port during activation while a four-way actuator is defined as one in which oil flows external to a control valve through two ports during activation.

The four-way hydraulic actuator creates a higher output force for a given input hydraulic pressure since the low pressure side of the piston is vented to atmosphere. The three-way valve connects both the top and the bottom of the piston to the same high pressure source and the difference in the cross-sectional area due to the valve stem causes a net force that opens the valve. Because the bottom of the piston is vented back to the high pressure side, the energy consumption of the three-way valve is significantly lower than the four-way. Thus, according to the present invention a high force output four-way valve is used to open the first exhaust valve against the residual cylinder pressure, and then three-way valves are used to subsequently open one or more exhaust valves in the same cylinder where both types of actuators use the same source of hydraulic pressures.

One provision of the present invention is to reduce the energy required to operate two or more exhaust valves by activating the first exhaust valve using a four-way actuator and the remaining exhaust valves using a three-way actuator.

Another provision of the present invention is to minimize the hydraulic supply pressure required to activate the engine valves by utilizing one four-way actuator for each cylinder to open a first exhaust valve.

Another provision of the present invention is to minimize the hydraulic supply pressure required to activate the engine valves by utilizing one four-way actuator for each cylinder to open a first exhaust valve and three-way actuators to open all other valves for each cylinder.

Another provision of the present invention is to first open an exhaust valve in each cylinder using a four-way actuator and then open another exhaust valve in the same cylinder using a three-way actuator.

Still another provision of the present invention is to minimize the energy required to hydraulically operate an engine valve train having at least two exhaust valves for each cylinder using one four-way actuator on one exhaust valve per cylinder.

BRIEF DESCRIPTION OF THE DRAWINGS

FIG. 1 is a cross-sectional view of a three-way hydraulic engine valve actuator;

FIG. 2 is a cross-sectional view of a four-way hydraulic engine valve actuator when activated;

FIG. 3 is a cross-sectional view of the four-way hydraulic engine valve actuator when deactivated; and FIG. 4 is a schematic diagram of the present invention showing the use of a four-way actuator to open one of the exhaust valves in a cylinder.

DETAILED DESCRIPTION OF THE PREFERRED EMBODIMENT

Certain terminology will be used in the following description for convenience in reference only and will not be limiting. The words "upwardly", "downwardly", "rightwardly", "leftwardly", "clockwise" and "counterclockwise" will designate directions in the drawings to which reference is made. The words "inwardly" and "outwardly" will refer to directions toward and away from, respectively, the geometric center of the device and designated parts thereof. Said terminology will include the words above specifically mentioned, derivatives thereof and words of similar import.

A cross-sectional view of a three-way electronically controlled hydraulic actuator 2 is shown in FIG. 1. The basic operation of the actuator 2 makes use of a source of high pressure oil to act on both sides of an actuator piston 9 that is connected to an engine valve 5. The arrows in FIG. 1 depict the flow of oil as the engine valve 5 is being opened by the high pressure oil acting on top of the actuator piston 9. The control of the flow of the high pressure oil is determined by the position of a spool valve 10 which moves axially in response to an electronically controlled solenoid 6. Upon energization of the control solenoid 6 by the electronic control unit 8, the spool valve 10 moves leftward to uncover oil flow port 21. Oil flow port 20 and flow port 22 are continuously open thereby allowing high pressure oil to move to and from the oil supply 3 through the upper oil passage 27 around the spool valve 10 and through the lower oil passage 19 to and from the lower piston cavity 17B. As flow port 21 is opened, the high pressure oil flows past flow port 21 into the upper piston cavity 17A. Thus, both the upper piston cavity 17A and the lower piston cavity 17B have high pressure oil present. The differential area between the area on top of the actuator piston 9, verses the reduced area at the bottom of the actuator piston 9 due to the presence of the engine valve 5, causes the actuator piston 9 to move downward which moves the engine valve 5 to an open position.

To close the engine valve 5, the solenoid 6 is turned off and the spool valve 10 is shifted rightward by a return spring 7. In the "off" position, the spool valve 10 vents the oil in the upper piston cavity 17A to atmosphere thereby allowing the high pressure oil in the lower piston cavity 17B to force the actuator piston 9 and the attached engine valve 5 upward and then hold the actuator piston 9 and the engine valve 5 in a closed position.

In more detail, a source of high pressure hydraulic oil is fed to the area labeled as oil supply 3 which is used to supply the primary actuation energy to the hydraulic actuator 2 to cause an engine valve 5 to translate upwardly and downwardly according to signals supplied by an electronic control unit 8. Note that the hydraulic oil can also function as the engine oil as used to supply the basic lubrication to the engine mechanicals.

The hydraulic actuator 2 is comprised of an upper actuator housing 4A slidingly connected to a lower actuator housing 4B. The control solenoid 6 is used to control when the hydraulic actuator 2 is energized or de-energized through the axial motion of the spool valve 10. In the three-way hydraulic actuator 2, the spool valve 10 moves laterally leftward and rightward within the valve bore 23 formed in the upper actuator housing 4A so as to control the flow of high pressure oil through the upper actuator housing 4A toward and away from the lower actuator housing 4B within the upper actuator housing 4A and also control the flow of hydraulic oil from an upper piston cavity 17A to atmosphere.

The solenoid 6 is comprised of a coil 13 which is wound around a magnetically conductive coil ring 11 and contained by solenoid cover 15 which is mounted to the side of the upper actuator housing 4A. When the solenoid 6 is energized, the spool valve 10 is moved magnetically to the left and when de-energized, the spool valve 10 is forced to the right by the return spring 7. The return spring 7 axially forces the spool valve 10 in a rightward direction so as to cause the hydraulic oil contained in the upper piston cavity 17A to be vented to atmosphere thereby allowing the engine valve 5 to assume its closed position due to the forces generated by the high pressure oil present in lower oil passage 19 which flows from flow control port 22 through lower oil passage 19 into the lower piston cavity 17B (opposite that shown in FIG. 1).

As shown in FIG. 1, when the coil 13 is energized by the electronic control unit 8, the magnetic field generated acts on the spool valve 10 and causes it to be moved leftwardly toward the solenoid 6. This movement opens flow port 21 and allows high pressure oil to flow into the upper piston cavity 17A. Even though high pressure oil also resides in the lower piston cavity 17B, the difference in the cross-sectional area of the actuator piston 9 exposed to the high pressure oil at the upper piston cavity 17A and the lower piston cavity 17B causes the actuator piston 9 to be forced downward to the full open position shown in FIG. 1.

The actuator piston 9 is attached to one end of the engine valve 5 and vertically traverses an upper piston cavity 17A formed in the body of the upper actuator housing 4A as the engine valve 5 moves upward and downward to open and close at the command of the electronic control unit 8 which sends electrical signals to the control solenoid 6. The lower actuator housing 4B sits on and can move relative to the head surface 18 thereby allowing the lower actuator housing 4B to self-position to minimize friction and wear between the lower actuator housing 4B and the engine valve 5 as they move relative one to the other. The lower actuator housing 4B is hydraulically sealed to the upper actuator housing 4A by way of sealing ring 14 which expands to contact in a sealing manner both the upper and lower actuator housing 4A and 4B.

The supply header 12 is stationary with respect to the engine cylinder head 16 and provides for a stable mounting surface for the hydraulic valve actuator 2. The upper actuator housing 4A has a relatively flat surface which contacts and seals against the supply header 12 where the overall effect is to trap the hydraulic valve actuator 2 between the supply header 12 and the head surface 18. In this manner, the hydraulic valve actuator 2 is free to position itself between the supply header 12 and the engine cylinder head 16 thereby self-aligning with the engine valve 5 to minimize friction and wear. Header seal 25 functions to seal the upper actuator housing 4A to the supply header 12 to prevent oil leakage. The header seal 25 is shown as an o-ring but other types of sealing devices can be employed to provide a similar function. As the oil pressure is increased in the lower piston cavity 17B, the upper actuator housing 4A tends to separate from the lower actuator housing 4B and the header seal 25 is further compressed by this movement thereby improving the sealing function.

An adjustment feature could be incorporated to adjust the separation between the supply header 12 and the upper actuator housing 4A. Shims (not shown) could be used to move the upper actuator housing 4A downward and thereby change the "snubbing point" of the hydraulic fluid (that being where the flow of oil out of the upper piston cavity 17A is prevented by the top of the engine valve moving into the area of the flow port 21) and reduce the closing velocity of the engine valve 5. The open position is shown in FIG. 1 where the closed position would require the spool valve 10 to be moved by the return spring 7 rightward to lower the oil pressure in the upper piston cavity 17A thereby causing the high pressure oil in the lower piston cavity 17B to move the actuator piston 9 upward. The valve 5 stops when it contacts the valve seat 26 but its motion as it nears the valve seat 26 is affected by the snubbing point. Thus, lowering or raising the upper actuator housing 4A relative to the oil supply header 12 will result in increasing or decreasing the engine valve 5 closing velocity.

Now referring to FIG. 2, a cross-sectional view of a four-way electronically controlled hydraulic actuator is shown. The major operational difference between the three-way actuator 2 and the four-way actuator 2A is that the four-way actuator 2A generates more force when opening the engine valve 5 because the lower piston cavity 17B is vented to atmosphere rather than back to the high pressure supply through flow port 22. This results in greater energy usage by the four-way actuator 2A, because the oil from the lower piston cavity 17B is dumped to atmosphere instead of being returned to the high pressure side as with three-way actuator 2.

The four-way actuator 2A uses a lengthened spool valve 10A to provide a vent to atmosphere to the lower piston cavity 17B when the engine valve 5 is opening. To close the engine valve 5, the spool valve 10A is returned to the rightward position whereupon the lower piston cavity 17B is connected to the high pressure oil supply while the upper piston cavity 17A is connected to atmosphere.

FIG. 2 illustrates a cross-sectional view of a four-way actuator 2A in an energized state. The arrows in the drawing depict the flow of oil as the engine valve 5 is being opened. The solenoid valve 10A has two flow control sections 24A and 24B which open and close flow ports 21 and 22 respectively as the solenoid valve 10A is moved leftwardly and rightwardly by the solenoid 6. In opening the exhaust valve 5, the solenoid 6 is energized by the electronic control unit 8 which causes the solenoid valve 10A to move to the left as depicted in FIG. 2. The high pressure oil from the oil supply 3 flows past the flow port 21 into the upper piston cavity 17A. The flow control sections 24B opens the flow port 22 to atmosphere allowing the oil contained in the lower piston cavity 17B to be vented to atmosphere and circulated back to the oil supply sump (not shown). Since the oil residing in the lower piston cavity 17B is vented to atmosphere rather than forced back to the high pressure supply 3, the four-way actuator 2A forces the engine valve 5 open with a significantly higher force level than the three-way actuator 2 shown in FIG. 1. Because of this, in an engine cylinder having more than one exhaust valve, a four-way actuator 2A can be used on the first exhaust valve to be opened to supply a high opening force to open the exhaust valve against the cylinder pressure and three-way actuators 2 can be used on the rest of the engine valves in the cylinder. In this manner, the present invention minimizes energy consumption to operate the engine valves since a three-way actuator 2 is more energy efficient than a four-way actuator 2A at the same oil supply pressure.

FIG. 3 is a cross-sectional view of a four-way actuator 2A as the engine valve 5 is being closed. The engine valve 5 has been opened as described previously with reference to FIG. 2 and now the solenoid 6 has been de-energized with the return spring 7 causing the spool valve 10A to move fully rightwardly as shown in FIG. 3. The flow control sections 24A and 24B have moved across the flow ports 21 and 22 respectively. Flow control section 24A has opened flow port 21 to atmosphere and flow control section 24B has opened flow port 22 to the high pressure supply 3 through flow port 20. As shown by the arrows in FIG. 3, the oil flows from the high pressure supply 3 through flow port 20 around flow control section 24B through flow port 22 into oil passage 19 into the lower piston cavity 17B. Since the upper piston cavity 17A is vented to atmosphere, the valve piston 9 is forced upward and the engine valve 5 moves upward to close the flow in engine port 28. FIG. 3 shows the engine valve 5 as it has just started to be moved upward to close.

FIG. 4 is a perspective view of the present invention showing one four-way actuator 2A used to operate the exhaust valve 5E which is opened first. One three-way actuator 2B is used to operate a second exhaust valve 5E while two other three-way actuators 2C and 2D are used to operate the intake valves 51.

Using the present invention the first exhaust valve 5E can be opened against the residual exhaust cylinder pressure using the same oil pressure source 3 as the other actuators by making use of a four-way actuator 2A to provide additional opening force. The draw back to the four-way actuator 2A is that since the oil in the lower piston cavity 17B is vented to atmosphere rather than returned to the high pressure source 3, energy is lost and the overall system efficiency is lower. In the alternative, to minimize the power consumed by the four-way actuator 2A, its stroke could be reduced which would serve the purpose of opening the exhaust valve 5E against cylinder pressure using the same high pressure oil supply as the three-way actuators 24A while reducing the quantity of oil vented to atmosphere.

The description above refers to particular embodiments of the present invention and it is understood that many modifications may be made without departing from the spirit thereof. The embodiments of the invention disclosed and described in the above specification and drawings are presented merely as examples of the invention. Other embodiments, materials, forms and modifications thereof are contemplated as falling within the scope of the present invention only limited by the claims as follows.

I claim:

1. A method of operating at least two exhaust valves in an engine cylinder comprising:

providing a four-way hydraulic actuator attached to a first exhaust valve;

providing a three-way hydraulic actuator attached to a second exhaust valve;

providing a source of pressurized oil to said four-way hydraulic actuator and to said three-way hydraulic actuator;

opening said four-way hydraulic actuator; then opening said three-way hydraulic actuator when the pressure in said engine cylinder has been substantially lowered.

2. The method of operating at least two exhaust valves in an engine cylinder of claim 1, further comprising:

providing a three-way hydraulic actuator for each additional exhaust valve; and opening all of said three-way hydraulic actuators when the pressure in said engine cylinder has been substantially lowered.

3. The method of operating at least two, exhaust valves in an engine cylinder of claim 1, wherein said source of pressurized oil is common to said four-way hydraulic actuator and said three-way hydraulic actuator.

* * * * *